US007778827B2

(12) United States Patent
Jelinek et al.

(10) Patent No.: US 7,778,827 B2
(45) Date of Patent: Aug. 17, 2010

(54) METHOD AND DEVICE FOR GAIN QUANTIZATION IN VARIABLE BIT RATE WIDEBAND SPEECH CODING

(75) Inventors: Milan Jelinek, Sherbrooke (CA); Redwan Salami, Québec (CA)

(73) Assignee: Nokia Corporation, Espoo (FI)

( * ) Notice: Subject to any disclaimer, the term of this patent is extended or adjusted under 35 U.S.C. 154(b) by 1131 days.

(21) Appl. No.: 11/039,538

(22) Filed: Jan. 19, 2005

(65) Prior Publication Data

US 2005/0251387 A1 Nov. 10, 2005

Related U.S. Application Data

(63) Continuation of application No. PCT/CA2004/000380, filed on Mar. 12, 2004.

(51) Int. Cl.
*G10L 19/12* (2006.01)

(52) U.S. Cl. ..... 704/223; 704/222; 704/230; 704/200; 704/219

(58) Field of Classification Search ..... 704/223, 704/222, 230, 219, 220, 200
See application file for complete search history.

(56) References Cited

U.S. PATENT DOCUMENTS

| | | | | |
|---|---|---|---|---|
| 6,260,010 | B1 * | 7/2001 | Gao et al. | 704/230 |
| 6,397,178 | B1 * | 5/2002 | Benyassine | 704/230 |
| 7,315,815 | B1 * | 1/2008 | Gersho et al. | 704/223 |

FOREIGN PATENT DOCUMENTS

| | | |
|---|---|---|
| JP | 09-120299 | 5/1997 |
| JP | 2002-328700 | 11/2002 |
| JP | 2003-295879 | 10/2003 |
| WO | WO 01/37264 A1 | 5/2001 |
| WO | WO-03/058407 A2 | 7/2003 |

OTHER PUBLICATIONS

Bessette, B, et al., "Techniques for High-Quality ACELP Coding of Wideband Speech", Eurospeech 2001, vol. 3, Sep. 3, 2001, 4 pgs.

3GPP: "3GPP TS26.190 V5.1 3rd Generation Partnership Project: Speech Codec Speech Processing Functions", Internet article, Online! Jan. 9, 2002, URL:http://www.3gpp.org/ftp/Specs/archive/26_series/26.190/26190-510.zip, pp. 1-53.

* cited by examiner

*Primary Examiner*—Qi Han
(74) *Attorney, Agent, or Firm*—Harrington & Smith

(57) ABSTRACT

The present invention relates to a gain quantization method and device for implementation in a technique for coding a sampled sound signal processed, during coding, by successive frames of L samples, wherein each frame is divided into a number of subframes and each subframe comprises a number N of samples, where N<L. In the gain quantization method and device, an initial pitch gain is calculated based on a number f of subframes, a portion of a gain quantization codebook is selected in relation to the initial pitch gain, and pitch and fixed-codebook gains are jointly quantized. This joint quantization of the pitch and fixed-codebook gains comprises, for the number f of subframes, searching the gain quantization codebook in relation to a search criterion. The codebook search is restricted to the selected portion of the gain quantization codebook and an index of the selected portion of the gain quantization codebook best meeting the search criterion is found.

64 Claims, 4 Drawing Sheets

METHOD AND DEVICE FOR GAIN QUANTIZATION IN VARIABLE BIT RATE WIDEBAND SPEECH CODING

CROSS REFERENCE TO RELATED APPLICATION

This application is a continuation of International Patent Application No. PCT/CA2004/000380 filed Mar. 12, 2004.

FIELD OF THE INVENTION

The present invention relates to an improved technique for digitally encoding a sound signal, in particular but not exclusively a speech signal, in view of transmitting and synthesizing this sound signal.

BACKGROUND OF THE INVENTION

Demand for efficient digital narrowband and wideband speech coding techniques with a good trade-off between the subjective quality and bit rate is increasing in various application areas such as teleconferencing, multimedia, and wireless communications. Until recently, telephone bandwidth constrained into a range of 200-3400 Hz has mainly been used in speech coding applications. However, wideband speech applications provide increased intelligibility and naturalness in communication compared to the conventional telephone bandwidth. A bandwidth in the range 50-7000 Hz has been found sufficient for delivering a good quality giving an impression of face-to-face communication. For general audio signals, this bandwidth gives an acceptable subjective quality, but is still lower than the quality of FM radio or CD that operate in the ranges of 20-16000 Hz and 20-20000 Hz, respectively.

A speech encoder converts a speech signal into a digital bit stream that is transmitted over a communication channel or stored in a storage medium. The speech signal is digitized, that is, sampled and quantized with usually 16-bits per sample. The speech encoder has the role of representing these digital samples with a smaller number of bits while maintaining a good subjective speech quality. The speech decoder or synthesizer operates on the transmitted or stored bit stream and converts it back to a sound signal.

Code-Excited Linear Prediction (CELP) coding is one of the best prior art techniques for achieving a good compromise between the subjective quality and bit rate. This coding technique constitutes a basis for several speech coding standards both in wireless and wire line applications. In CELP coding, the sampled speech signal is processed in successive blocks of L samples usually called frames, where L is a predetermined number corresponding typically to 10-30 ms. A linear prediction (LP) filter is computed and transmitted every frame. The computation of the LP filter typically needs a lookahead, i.e. a 5-15 ms speech segment from the subsequent frame. The L-sample frame is divided into smaller blocks called subframes. Usually the number of subframes is three or four resulting in 4-10 ms subframes. In each subframe, an excitation signal is usually obtained from two components, the past excitation and the innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of the LP filter.

In wireless systems using Code Division Multiple Access (CDMA) technology, the use of source-controlled variable bit rate (VBR) speech coding significantly improves the capacity of the system. In source-controlled VBR coding, the codec operates at several bit rates, and a rate selection module is used to determine which bit rate is used for encoding each speech frame based on the nature of the speech frame (e.g. voiced, unvoiced, transient, background noise, etc.). The goal is to attain the best speech quality at a given average bit rate, also referred to as average data rate (ADR). The codec can operate with different modes by tuning the rate selection module to attain different ADRs in the different modes of operation where the codec performance is improved at increased ADRs. The mode of operation is imposed by the system depending on channel conditions. This enables the codec with a mechanism of trade-off between speech quality and system capacity. In CDMA systems (e.g. CDMA-one and CDMA2000), typically 4 bit rates are used and they are referred to as full-rate (FR), half-rate (HR), quarter-rate (QR), and eighth-rate (ER). In this system two rate sets are supported referred to as Rate Set I and Rate Set II. In Rate Set II, a variable-rate codec with rate selection mechanism operates at source-coding bit rates of 13.3 (FR), 6.2 (HR), 2.7 (QR), and 1.0 (ER) kbit/s, corresponding to gross bit rates of 14.4, 7.2, 3.6, and 1.8 kbit/s (with some bits added for error detection).

Typically, in VBR coding for CDMA systems, the eighth-rate is used for encoding frames without speech activity (silence or noise-only frames). When the frame is stationary voiced or stationary unvoiced, half-rate or quarter-rate are used depending on the mode of operation. When half-rate is used for the stationary unvoiced frames, a CELP model without the pitch codebook is used. When the half-rate is used in case of stationary voiced frames, signal modification is used to enhance the periodicity and reduce the number of bits for the pitch indices. If the mode of operation imposes a quarter-rate, no waveform matching is usually possible as the number of bits is insufficient and some parametric coding is generally applied. Full-rate is used for onsets, transient frames, and mixed voiced frames (a typical CELP model is usually used). In addition to the source controlled codec operation in CDMA systems, the system can limit the maximum bit rate in some speech frames in order to send in-band signaling information (called dim-and-burst signaling) or during bad channel conditions (such as near the cell boundaries) in order to improve the codec robustness. This is referred to as half-rate max. When the rate selection module chooses the frame to be encoded as a full-rate frame and the system imposes for example HR frame, the speech performance is degraded since the dedicated HR modes are not capable of efficiently encoding onsets and transient signals. Another generic HR coding model is designed to cope with these special cases.

An adaptive multi-rate wideband (AMR-WB) speech codec was adopted by the ITU-T (International Telecommunications Union—Telecommunication Standardization Sector) for several wideband speech telephony and services and by 3GPP (Third Generation Partnership Project) for GSM and W-CDMA third generation wireless systems. AMR-WB codec consists of nine bit rates, namely 6.60, 8.85, 12.65, 14.25, 15.85, 18.25, 19.85, 23.05, and 23.85 kbit/s. Designing an AMR-WB-based source controlled VBR codec for CDMA systems has the advantage of enabling the interoperation between CDMA and other systems using the AMR-WB codec. The AMR-WB bit rate of 12.65 kbit/s is the closest rate that can fit in the 13.3 kbit/s full-rate of Rate Set II. This rate can be used as the common rate between a CDMA wideband VBR codec and AMR-WB to enable the interoperability without the need for transcoding (which degrades the speech quality). Lower rate coding types must be designed specifically for the CDMA VBR wideband solution to enable an efficient operation in the Rate Set II framework. The codec then can operate in few CDMA-specific modes using all rates but it will have a mode that enables interoperability with systems using the AMR-WB codec.

In VBR coding based on CELP, typically all classes, except for the unvoiced and inactive speech classes, use both a pitch (or adaptive) codebook and an innovation (or fixed) codebook to represent the excitation signal. Thus the encoded excitation consists of the pitch delay (or pitch codebook index), the pitch gain, the innovation codebook index, and the innovation codebook gain. Typically, the pitch and innovation gains are jointly quantized, or vector quantized, to reduce the bit rate. If individually quantized, the pitch gain requires 4 bits and the innovation codebook gain requires 5 or 6 bits. However, when jointly quantized, 6 or 7 bits are sufficient (saving 3 bits per 5 ms subframe is equivalent to saving 0.6 kbit/s). In general, the quantization table, or codebook, is trained using all types of speech segments (e.g. voiced, unvoiced, transient, onset, offset, etc.). In the context of VBR coding, the half-rate coding models are usually class-specific. So different half-rate models are designed for different signal classes (voiced, unvoiced, or generic). Thus new quantization tables need to be designed for these class-specific coding models.

SUMMARY OF THE INVENTION

The present invention relates to a gain quantization method for implementation in a technique for coding a sampled sound signal processed, during coding, by successive frames of L samples, wherein:

each frame is divided into a number of subframes;

each subframe comprises a number N of samples, where N<L; and the gain quantization method comprises: calculating an initial pitch gain based on a number f of subframes; selecting a portion of a gain quantization codebook in relation to the initial pitch gain; identifying the selected portion of the gain quantization codebook using at least one bit per successive group of f subframes; and jointly quantizing pitch and fixed-codebook gains.

The joint quantization of the pitch and fixed-codebook gains comprises, for the number f of subframes, searching the gain quantization codebook in relation to a search criterion. Searching of the gain quantization codebook comprises restricting the codebook search to the selected portion of the gain quantization codebook and finding an index of the selected portion of the gain quantization codebook best meeting the search criterion.

The present invention also relates to a gain quantization device for implementation in a system for coding a sampled sound signal processed, during coding, by successive frames of L samples, wherein:

each frame is divided into a number of subframes;

each subframe comprises a number N of samples, where N<L; and the gain quantization device comprises: means for calculating an initial pitch gain based on a number f of subframes; means for selecting a portion of a gain quantization codebook in relation to the initial pitch gain; means for identifying the selected portion of the gain quantization codebook using at least one bit per successive group of f subframes; and means for jointly quantizing pitch and fixed-codebook gains.

The means for jointly quantizing the pitch and fixed-codebook gains comprises means for searching the gain quantization codebook in relation to a search criterion. The latter searching means comprises means for restricting, for the number f of subframes, the codebook search to the selected portion of the gain quantization codebook, and means for finding an index of the selected portion of the gain quantization codebook best meeting the search criterion.

The present invention is further concerned with a gain quantization device for implementation in a technique for coding a sampled sound signal processed, during coding, by successive frames of L samples, wherein:

each frame is divided into a number of subframes;

each subframe comprises a number N of samples, where N<L; and the gain quantization device comprises: a calculator of an initial pitch gain based on a number f of subframes; a selector of a portion of a gain quantization codebook in relation to the initial pitch gain; an identifier of the selected portion of the gain quantization codebook using at least one bit per successive group of f subframes; and a joint quantizer for jointly quantizing pitch and fixed-codebook gains.

The joint quantizer comprises a searcher of the selected portion of the gain quantization codebook in relation to a search criterion, this searcher of the gain quantization codebook restricting the codebook search to the selected portion of the gain quantization codebook and finding an index of the selected portion of the gain quantization codebook best meeting the search criterion.

The present invention is still further concerned with a gain quantization method for implementation in a technique for coding a sampled sound signal processed, during coding, by successive frames of L samples, wherein each frame is divided into a number of subframes, and each subframe comprises a number N of samples, where N<L. This gain quantization method comprises:

calculating an initial pitch gain based on a period K longer than the subframe;

selecting a portion of a gain quantization codebook in relation to the initial pitch gain;

identifying the selected portion of the gain quantization codebook using at least one bit per successive group of f subframes; and jointly quantizing pitch and fixed-codebook gains, this joint quantization of the pitch and fixed-codebook gains comprising:

searching the gain quantization codebook in relation to a search criterion, that searching of the gain quantization codebook comprising restricting the codebook search to the selected portion of the gain quantization codebook and finding an index of the selected portion of the gain quantization codebook best meeting the search criterion; and calculating an initial pitch gain based on a period K longer than the subframe comprises using the following relation:

$$g_p' = \frac{\sum_{n=0}^{K-1} s_w(n)s_w(n-T_{OL})}{\sum_{n=0}^{K-1} s_w(n-T_{OL})s_w(n-T_{OL})}$$

where $T_{OL}$ is an open-loop pitch delay and $s_w(n)$ is a signal derived from a perceptually weighted version of the sampled sound signal.

Finally, the present invention relates to a gain quantization device for implementation in a technique for coding a sampled sound signal processed, during coding, by successive frames of L samples, wherein each frame is divided into a number of subframes, and each subframe comprises a number N of samples, where N<L. the gain quantization device comprises:

a calculator of an initial pitch gain based on a period K longer than the subframe;

a selector of a portion of a gain quantization codebook in relation to the initial pitch gain;

an identifier of the selected portion of the gain quantization codebook using at least one bit per successive group of f subframes; and a joint quantizer for jointly quantizing pitch and fixed-codebook gains, this joint quantizer comprising:

a searcher of the selected portion of the gain quantization codebook in relation to a search criterion, this searcher of the gain quantization codebook restricting the codebook search to the selected portion of the gain quantization codebook and finding an index of the selected portion of the gain quantization codebook best meeting the search criterion; and the calculator of the initial pitch gain comprises the following relation used to calculate the initial pitch gain $g'_p$:

$$g'_p = \frac{\sum_{n=0}^{K-1} s_w(n)s_w(n-T_{OL})}{\sum_{n=0}^{K-1} s_w(n-T_{OL})s_w(n-T_{OL})}$$

where $T_{OL}$ is an open-loop pitch delay and $s_w(n)$ is a signal derived from a perceptually weighted version of the sound signal.

The foregoing and other objects, advantages and features of the present invention will become more apparent upon reading of the following non restrictive description of illustrative embodiments thereof, given by way of example only with reference to the accompanying drawings.

DETAILED DESCRIPTION OF THE ILLUSTRATIVE EMBODIMENTS

Although the non-restrictive illustrative embodiments of the present invention will be described in relation to a speech signal, it should be kept in mind that the present invention can also be applied to other types of sound signals such as, for example, audio signals.

Figure 1:
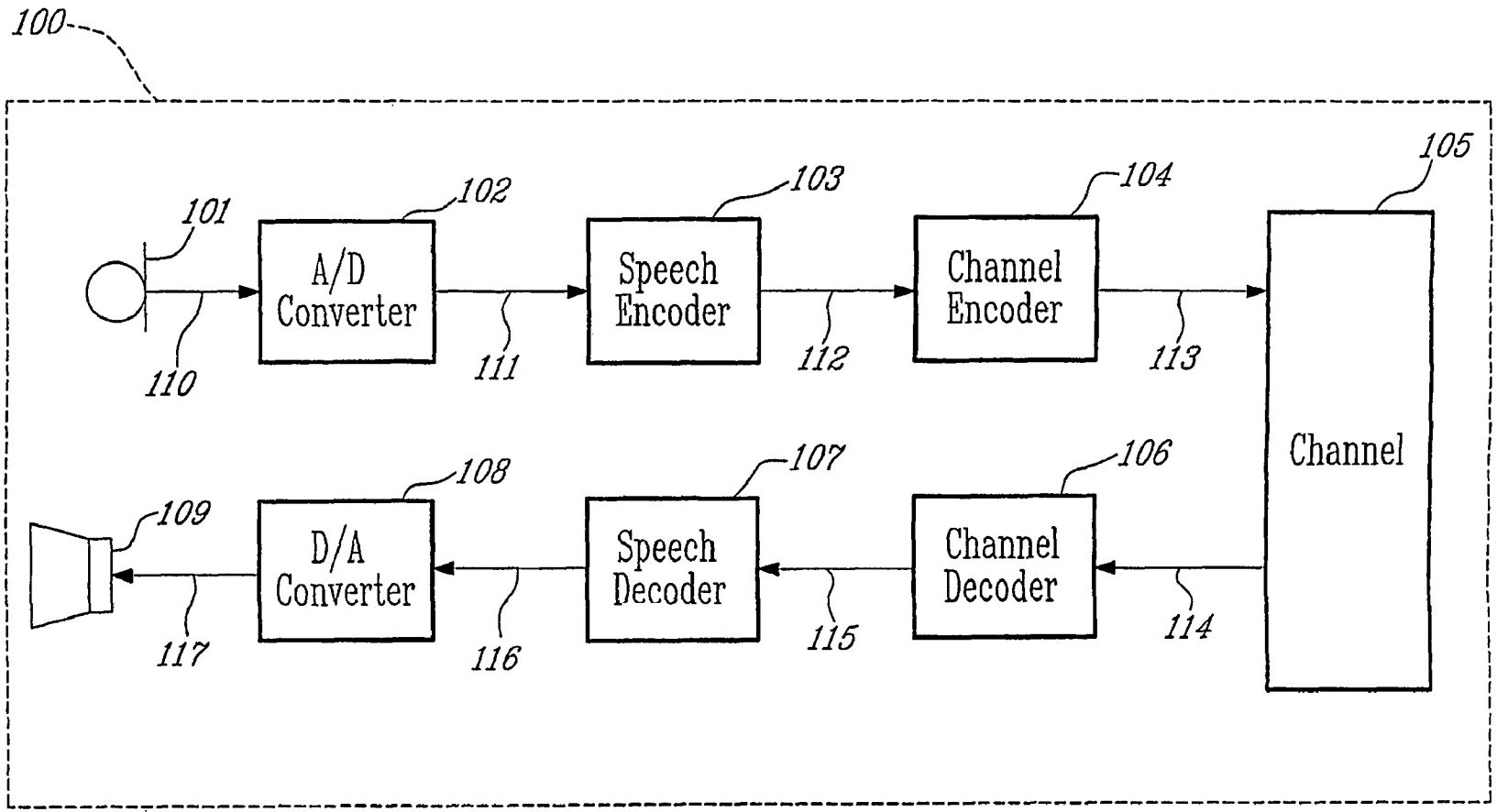
FIG. 1 Prior Art
FIG. 1 is a schematic block diagram of a speech communication system illustrating the context in which speech encoding and decoding devices in accordance with the present invention are used.

FIG. 1 illustrates a speech communication system 100 depicting the context in which speech encoding and decoding devices in accordance with the present invention are used. The speech communication system 100 supports transmission and reproduction of a speech signal across a communication channel 105. Although it may comprise for example a wire, optical or fiber link, the communication channel 105 typically comprises at least in part a radio frequency link. The radio frequency link often supports multiple, simultaneous speech communications requiring shared bandwidth resources such as may be found with cellular telephony embodiments. Although not shown, the communication channel 105 may be replaced by a storage unit in a single device embodiment of the communication system that records and stores the encoded speech signal for later playback.

On the transmitter side, a microphone 101 converts speech to an analog speech signal 110 supplied to an analog-to-digital (A/D) converter 102. The function of the A/D converter 102 is to convert the analog speech signal 110 to a digital speech signal 111. A speech encoder 103 codes the digital speech signal 111 to produce a set of signal-coding parameters 112 under a binary form and delivered to an optional channel encoder 104. The optional channel encoder 104 adds redundancy to the binary representation of the signal-coding parameters 112 before transmitting them (see 113) over the communication channel 105.

On the receiver side, a channel decoder 106 utilizes the redundant information in the received bit stream 114 to detect and correct channel errors occurred during the transmission. A speech decoder 107 converts the bit stream 115 received from the channel decoder back to a set of signal-coding parameters for creating a synthesized speech signal 116. The synthesized speech signal 116 reconstructed in the speech decoder 107 is converted back to an analog speech signal 117 in a digital-to-analog (D/A) converter 108. Finally, the analog speech signal 117 is played back through a loudspeaker unit 109.

Overview of the AMR-WB Encoder

This section will give an overview of the AMR-WB encoder operating at a bit rate of 12.65 kbit/s. This AMR-WB encoder will be used as the full-rate encoder in the non-restrictive, illustrative embodiments of the present invention.

Figure 2:
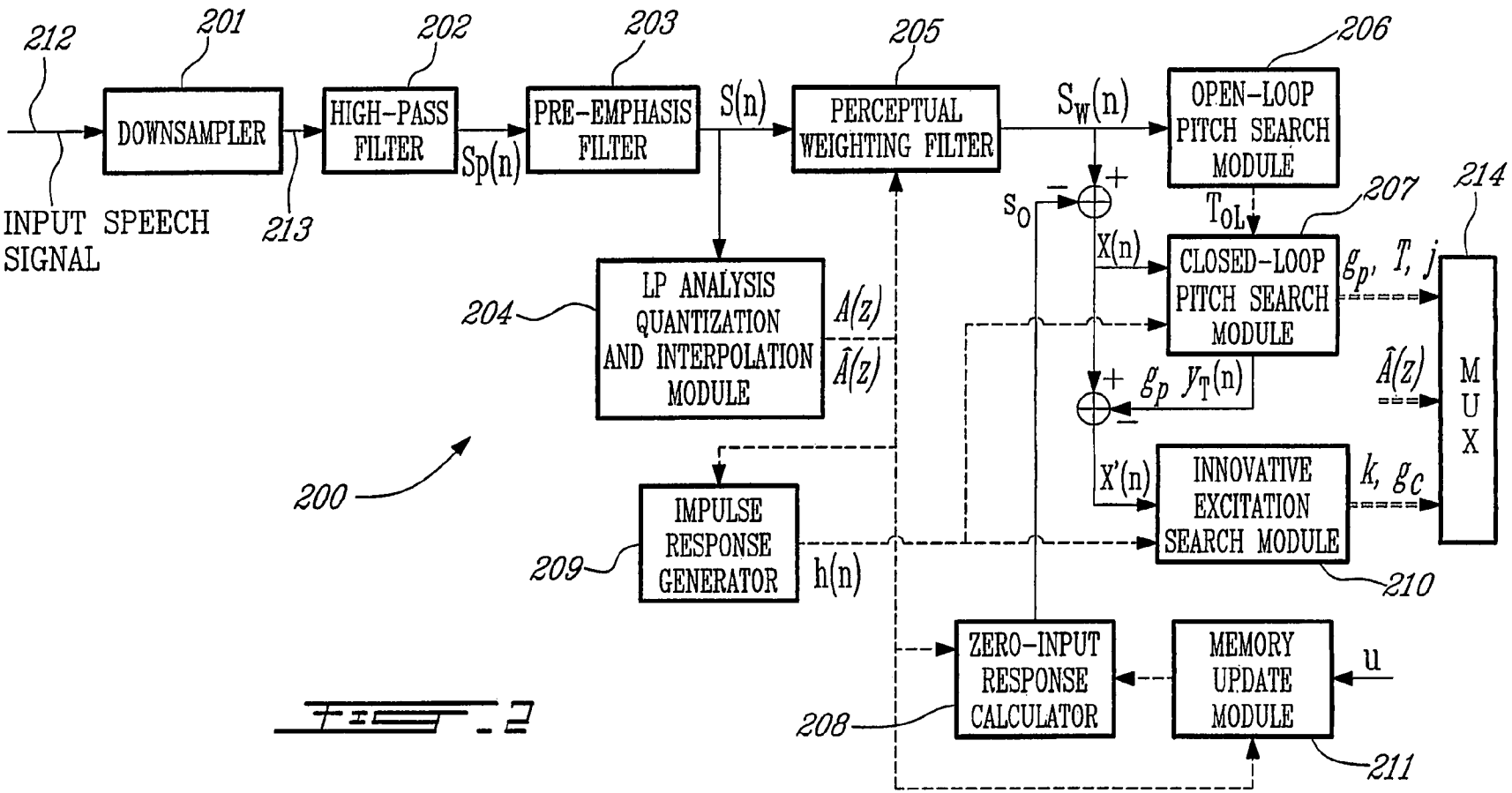
FIG. 2 is functional block diagram of the adaptive multi-rate wideband (AMR-WB) encoder.

The input, sampled sound signal 212, for example a speech signal, is processed or encoded on a block by block basis by the encoder 200 of FIG. 2, which is broken down into eleven modules numbered from 201 to 211.

The input sampled speech signal 212 is processed into the above mentioned successive blocks of L samples called frames.

Referring to FIG. 2, the input sampled speech signal 112 is down-sampled in a down-sampler 201. The input speech signal 212 is down-sampled from a sampling frequency of 16 kHz down to a sampling frequency of 12.8 kHz, using techniques well known to those of ordinary skill in the art. Down-sampling increases the coding efficiency, since a smaller frequency bandwidth is coded. Down-sampling also reduces the algorithmic complexity since the number of samples in a frame is decreased. After down-sampling, a 320-sample frame of 20 ms is reduced to a 256-sample frame 213 (down-sampling ratio of 4/5).

The down-sampled frame 213 is then supplied to an optional pre-processing unit. In the non-restrictive example of FIG. 2, the pre-processing unit consists of a high-pass filter 202 with a cut-off frequency of 50 Hz. This high-pass filter 202 removes the unwanted sound components below 50 Hz.

The down-sampled, pre-processed signal is denoted by $s_p(n)$, where n=0, 1, 2, . . . ,L−1, and L is the length of the frame (256 at a sampling frequency of 12.8 kHz). According to a non restrictive example, the signal $s_p(n)$ is pre-emphasized using a pre-emphasis filter 203 having the following transfer function:

$$P(z)=1-\mu z^{-1} \quad (1)$$

where μ is a pre-emphasis factor with a value located between 0 and 1 (a typical value is μ=0.7). The function of the pre-emphasis filter 203 is to enhance the high frequency contents of the input speech signal. The pre-emphasis filter 203 also reduces the dynamic range of the input speech signal, which renders it more suitable for fixed-point implementation. Pre-emphasis also plays an important role in achieving a proper overall perceptual weighting of the quantization error, which contributes to improve the sound quality. This will be explained in more detail herein below.

The output signal of the pre-emphasis filter 203 is denoted s(n). This signal s(n) is used for performing LP analysis in a LP analysis, quantization and interpolation module 204. LP analysis is a technique well known to those of ordinary skill in the art. In the non-restrictive illustrative example of FIG. 2, the autocorrelation approach is used. According to the autocorrelation approach, the signal s(n) is first windowed using typically a Hamming window having usually a length of the order of 30-40 ms. Autocorrelations are computed from the windowed signal, and Levinson-Durbin recursion is used to compute LP filter coefficients, $a_i$, where i=1, 2, . . . ,p, and where p is the LP order, which is typically 16 in wideband coding. The parameters $a_i$ are the coefficients of the transfer function of the LP filter, which is given by the following relation:

$$A(z) = 1 + \sum_{i=1}^{p} a_i z^{-i} \quad (2)$$

LP analysis is performed in the LP analysis, quantization and interpolation module 204, which also performs quantization and interpolation of the LP filter coefficients. The LP filter coefficients $a_i$ are first transformed into another equivalent domain more suitable for quantization and interpolation purposes. The Line Spectral Pair (LSP) and Immitance Spectral Pair (ISP) domains are two domains in which quantization and interpolation can be efficiently performed. The 16 LP filter coefficients $a_i$ can be quantized with a number of bits of the order of 30 to 50 using split or multi-stage quantization, or a combination thereof. The purpose of the interpolation is to enable updating of the LP filter coefficients $a_i$ every subframe while transmitting them once every frame, which improves the encoder performance without increasing the bit rate. Quantization and interpolation of the LP filter coefficients is believed to be otherwise well known to those of ordinary skill in the art and, accordingly, will not be further described in the present specification.

The following paragraphs will describe the rest of the coding operations performed on a subframe basis. In the non-restrictive, illustrative example of FIG. 2, the input frame is divided into 4 subframes of 5 ms (64 samples at 12.8 kHz sampling). In the following description, the filter A(z) denotes the unquantized interpolated LP filter of the subframe, and the filter $\hat{A}(z)$ denotes the quantized interpolated LP filter of the subframe.

In analysis-by-synthesis encoders, the optimum pitch and innovation parameters are searched by minimizing the mean squared error between the input speech and the synthesized speech in a perceptually weighted domain. A perceptually weighted signal, denoted $s_w(n)$ in FIG. 2, is computed in a perceptual weighting filter 205. A perceptual weighting filter 205 with fixed denominator, suited for wideband signals, is used. An example of transfer function for the perceptual weighting filter 205 is given by the following relation:

$$W(z)=A(z/y_1)/(1-y_2z^{-1}) \text{ where } 0<y_2<y_1\leqq 1$$

In order to simplify the pitch analysis, an open-loop pitch lag $T_{OL}$ is first estimated in an open-loop pitch search module 206 using the weighted speech signal $s_w(n)$. Then the closed-loop pitch analysis, which is performed in a closed-loop pitch search module 207 on a subframe basis, is restricted around the open-loop pitch lag $T_{OL}$, to thereby significantly reduce the search complexity of the LTP parameters T and $g_p$ (pitch lag and pitch gain, respectively). The open-loop pitch analysis is usually performed in module 206 once every 10 ms (two subframes) using techniques well known to those of ordinary skill in the art.

The target vector x for Long Term Prediction (LTP) analysis is first computed. This is usually done by subtracting the zero-input response $s_0$ of weighted synthesis filter $W(z)/\hat{A}(z)$ from the weighted speech signal $s_w(n)$. This zero-input response $s_0$ is calculated by a zero-input response calculator 208 in response to the quantized interpolation LP filter $\hat{A}(z)$ from the LP analysis, quantization and interpolation module 204 and to the initial states of the weighted synthesis filter $W(z)/\hat{A}(z)$ stored in memory update module 211 in response to the LP filters A(z) and $\hat{A}(z)$, and the excitation vector u. This operation is well known to those of ordinary skill in the art and, accordingly, will not be further described in the present specification.

A N-dimensional impulse response vector h of the weighted synthesis filter $W(z)/\hat{A}(z)$ is computed in the impulse response generator 209 using the coefficients of the LP filter A(z) and $\hat{A}(z)$ from the LP analysis, quantization and interpolation module 204. Again, this operation is well known to those of ordinary skill in the art and, accordingly, will not be further described in the present specification.

The closed-loop pitch (or pitch codebook) parameters $g_p$, T and j are computed in the closed-loop pitch search module 207, which uses the target vector x(n), the impulse response vector h(n) and the open-loop pitch lag $T_{OL}$ as inputs.

The pitch search consists of finding the best pitch lag T and gain $g_p$ that minimize a mean squared weighted pitch prediction error, for example $$e^{(j)}=\|x-b^{(j)}y^{(j)}\|^2 \text{ where } j=1, 2, \ldots, k$$

between the target vector x(n) and a scaled filtered version of the past excitation $g_p\, y_T(n)$.

More specifically, the pitch codebook (adaptive codebook) search is composed of three stages.

In the first stage, an open-loop pitch lag $T_{OL}$ is estimated in the open-loop pitch search module 206 in response to the weighted speech signal $s_w(n)$. As indicated in the foregoing description, this open-loop pitch analysis is usually performed once every 10 ms (two subframes) using techniques well known to those of ordinary skill in the art.

In the second stage, a search criterion C is searched in the closed-loop pitch search module 207 for integer pitch lags around the estimated open-loop pitch lag $T_{OL}$ (usually ±5), which significantly simplifies the pitch codebook search procedure. A simple procedure is used for updating the filtered codevector $y_T(n)$ (this vector is defined in the following description) without the need to compute the convolution for every pitch lag. An example of search criterion C is given by:

$$C = \frac{x^t y_T}{\sqrt{y_T^t y_T}}$$

where t denotes vector transpose

Once an optimum integer pitch lag is found in the second stage, a third stage of the search (closed-loop pitch search module 207) tests, by means of the search criterion C, the fractions around that optimum integer pitch lag. For example, the AMR-WB encoder uses ¼ and ½ subsample resolution.

In wideband signals, the harmonic structure exists only up to a certain frequency, depending on the speech segment. Thus, in order to achieve efficient representation of the pitch contribution in voiced segments of a wideband speech signal, flexibility is needed to vary the amount of periodicity over the wideband spectrum. This is achieved by processing the pitch codevector through a plurality of frequency shaping filters (for example low-pass or band-pass filters), and the frequency shaping filter that minimizes the above defined mean-squared weighted error $e^{(j)}$ is selected. The selected frequency shaping filter is identified by an index j.

The pitch codebook index T is encoded and transmitted to a multiplexer 214 for transmission through a communication channel. The pitch gain $g_p$ is quantized and transmitted to the multiplexer 214. An extra bit is used to encode the index j, this extra bit being also supplied to the multiplexer 214.

Once the pitch, or Long Term Prediction (LTP) parameters $g_p$, T, and j are determined, the next step consists of searching for the optimum innovative (fixed codebook) excitation by means of the innovative excitation search module 210 of FIG. 2. First, the target vector x(n) is updated by subtracting the LTP contribution:

$$x'(n)=x(n)-g_p y_T(n)$$

where $g_p$ is the pitch gain and $y_T(n)$ is the filtered pitch codebook vector (the past excitation at pitch delay T filtered with the selected frequency shaping filter (index j) and convolved with the impulse response h(n)).

The innovative excitation search procedure in CELP is performed in an innovation (fixed) codebook to find the optimum excitation (fixed codebook) codevector $c_k$ and gain $g_c$ which minimize the mean-squared error E between the target vector x'(n) and a scaled filtered version of the codevector $c_k$, for example:

$$E=\|x'-g_c H c_k\|^2$$

where H is a lower triangular convolution matrix derived from the impulse response vector h(n). The index k of the innovation codebook corresponding to the found optimum codevector $c_k$ and the gain $g_c$ are supplied to the multiplexer 214 for transmission through a communication channel.

It should be noted that the used innovation codebook can be a dynamic codebook consisting of an algebraic codebook followed by an adaptive pre-filter F(z) which enhances given spectral components in order to improve the synthesis speech quality, according to U.S. Pat. No. 5,444,816 granted to Adoul et al. on Aug. 22, 1995. More specifically, the innovative codebook search can be performed in module 210 by means of an algebraic codebook as described in U.S. Pat. No. 5,444,816 (Adoul et al.) issued on Aug. 22, 1995; U.S. Pat. No. 5,699,482 granted to Adoul et al., on Dec. 17, 1997; U.S. Pat. No. 5,754,976 granted to Adoul et al., on May 19, 1998; and U.S. Pat. No. 5,701,392 (Adoul et al.) dated Dec. 23, 1997.

The index k of the optimum innovation codevector is transmitted. As a non-limitative example, an algebraic codebook is used where the index consists of the positions and signs of the non-zero-amplitude pulses in the excitation vector. The pitch gain $g_p$ and innovation gain $g_c$ are finally quantized using a joint quantization procedure that will be described in the following description.

The bit allocation of the AMR-WB encoder operating at 12.65 kbit/s is given in Table 1.

TABLE 1

Bit allocation in the 12.65-kbit/s mode in accordance with the AMR-WB standard.

| Parameter | Bits/Frame |
|---|---|
| LP Parameters | 46 |
| Pitch Delay | 30 = 9 + 6 + 9 + 6 |
| Pitch Filtering | 4 = 1 + 1 + 1 + 1 |
| Gains | 28 = 7 + 7 + 7 + 7 |
| Algebraic Codebook | 144 = 36 + 36 + 36 + 36 |
| VAD (Voice Activity Detector) flag | 1 |
| Total | 253 bits = 12.65 kbit/s |

Joint Quantization of Gains

The pitch codebook gain $g_p$ and the innovation codebook gain $g_c$ can be either scalar or vector quantized.

In scalar quantization, the pitch gain is independently quantized using typically 4 bits (non-uniform quantization in the range 0 to 1.2). The innovation codebook gain is usually quantized using 5 or 6 bits; the sign is quantized with 1 bit and the magnitude with 4 or 5 bits. The magnitude of the gains is usually quantized uniformly in the logarithmic domain.

In joint or vector quantization, a quantization table, or a gain quantization codebook, is designed and stored at both the encoder and decoder ends. This codebook can be a two-dimensional codebook having a size that depends on the number of bits used to quantize the two gains $g_p$ and $g_c$. For example, a 7-bit codebook used to quantize the two gains $g_p$ and $g_c$ contains 128 entries with a dimension of 2. The best entry for a certain subframe is found by minimizing a certain error criterion. For example, the best codebook entry can be searched by minimizing a mean squared error between the input signal and the synthesized signal.

To further exploit the signal correlation, prediction can be performed on the innovation codebook gain $g_c$. Typically, prediction is performed on the scaled innovation codebook energy in the logarithmic domain.

Prediction can be conducted, for example, using moving average (MA) prediction with fixed coefficients. For example, a 4th order MA prediction is performed on the innovation codebook energy as follows. Let E(n) be the mean-removed innovation codebook energy (in dB) at subframe n, and given by:

$$E(n) = 10\log\left(\frac{1}{N}g_c^2\sum_{i=0}^{N-1}c^2(i)\right) - \overline{E} \tag{3}$$

where N is the size of the subframe, c(i) is the innovation codebook excitation, and $\overline{E}$ is the mean of the innovation codebook energy in dB. In this non-limitative example, N=64 corresponding to 5 ms at the sampling frequency of 12.8 kHz and $\overline{E}$=30 dB. The innovation codebook predicted energy is given by:

$$\tilde{E}(n) = \sum_{i=1}^{4} b_i \hat{R}(n-i) \tag{4}$$

where $[b_1, b_2, b_3, b_4]$=[0.5,0.4,0.3,0.2] are the MA prediction coefficients, and $\hat{R}(n-i)$ is the quantized energy prediction error at subframe n−i. The innovation codebook predicted energy is used to compute a predicted innovation gain $g'_c$ as in Equation (3) by substituting E(n) by $\tilde{E}(n)$ and $g_c$ by $g'_c$. This is done as follows. First, the mean innovation codebook energy is calculated using the following relation:

$$E_i = 10\log\left(\frac{1}{N}\sum_{i=0}^{N-1}c^2(i)\right) \tag{5}$$

and then the predicted innovation gain $g'_c$ is found by $$g'_c = 10^{0.05(\tilde{E}(n)+\overline{E}-E_I)} \tag{6}$$

A correction factor between the gain $g_c$, as computed during processing of the input speech signal 212, and the estimated, predicted gain $g'_c$ is given by:

$$y = g_c/g'_c. \tag{7}$$

Note that the energy prediction error is given by:

$$R(n) = E(n) - \tilde{E}(n) = 20\log(y) \tag{8}$$

The pitch gain $g_p$ and correction factor y are jointly vector quantized using a 6-bit codebook for AMR-WB rates of 8.85 kbits/s and 6.60 kbit/s, and a 7-bit codebook for the other AMR-WB rates. The search of the gain quantization codebook is performed by minimizing the mean-square of the weighted error between the original and reconstructed speech which is given by the following relation:

$$E = x'x + g_p^2 y'y + g_c^2 z'z - 2g_p x'y - 2g_c x'z + 2g_p g_c y'z, \tag{9}$$

where x is the target vector, y is the filtered pitch codebook signal (the signal y(n) is usually computed as the convolution between the pitch codebook vector and the impulse response h(n) of the weighted synthesis filter), z is the innovation codebook vector filtered through the weighted synthesis filter, and t denotes "transpose". The quantized energy prediction error associated with the chosen gains is used to update $\hat{R}(n)$.

Gain Quantization in Variable Bit Rate Coding

The use of source-controlled VBR speech coding significantly improves the capacity of many communication systems, especially wireless systems using CDMA technology. In source-controlled VBR coding, the codec operates at several bit rates, and a rate selection module is used to determine the bit rate to be used for encoding each speech frame based on the nature of the speech frame, e.g. voiced, unvoiced, transient, background noise, etc. The goal is to obtain the best speech quality at a given average bit rate. The codec can operate at different modes by tuning the rate selection module to attain different Average Data Rates (ADRs), where the codec performance improves with increasing ADRs. In some communication systems, the mode of operation can be imposed by the system depending on channel conditions. This provides the codec with a mechanism of trade-off between speech quality and system capacity. The codec then comprises a signal classification algorithm to analyze the input speech signal and classify each speech frame into one of a set of predetermined classes, for example background noise, voiced, unvoiced, mixed voiced, transient, etc. The codec also comprises a rate selection algorithm to decide what bit rate and what coding model is to be used based on the determined class of the speech frame and desired average bit rate.

As an example, when a CDMA2000 system is used (this system will be referred to as CDMA system), typically 4 bit rates are used and they are referred to as full-rate (FR), half-rate (HR), quarter-rate (QR), and eighth-rate (ER). Also, two rate sets referred to as Rate Set I and Rate Set II are supported by the CDMA system. In Rate Set II, a variable-rate codec with rate selection mechanism operates at source-coding bit rates of 13.3 (FR), 6.2 (HR), 2.7 (QR), and 1.0 (ER) kbit/s. In Rate Set I, the source-coding bit rates are 8.55 (FR), 4.0 (HR), 2.0 (QR), and 0.8 (ER) kbit/s. Rate Set II will be considered in the non-restrictive illustrative embodiments of the present invention.

In multi-mode VBR coding, different operating modes corresponding to different average bit rates can be obtained by defining the percentage of usage of individual bit rates. Thus, the rate selection algorithm decides the bit rate to be used for a certain speech frame based on the nature of the speech frame (classification information) and the required average bit rate.

In addition to imposing the operating mode, the CDMA system can also limit the maximum bit rate in some speech frames in order to send in-band signaling information (called dim-and-burst signaling) or during bad channel conditions (such as near the cell boundaries) in order to improve the codec robustness.

In the non-restrictive illustrative embodiments of the present invention, a source controlled multi-mode variable bit rate coding system that can operate in Rate Set II of CDMA2000 systems is used. It will be referred to in the following description as the VMR-WB (Variable Multi-Rate Wide-Band) codec. The latter codec is based on the adaptive multi-rate wideband (AMR-WB) speech codec as described in the foregoing description. The full rate (FR) coding is based on the AMR-WB at 12.65 kbit/s. For stationary voiced frames, a Voiced HR coding model is designed. For unvoiced frames, an Unvoiced HR and Unvoiced QR coding models are designed. For background noise frames (inactive speech), an ER comfort noise generator (CNG) is designed. When the rate selection algorithm chooses the FR model for a specific frame, but the communications system imposes the use of HR for signaling purposes, then neither Voiced HR nor Unvoiced HR are suitable for encoding the frame. For this purpose, a Generic HR model was designed. The Generic HR model can be also used for encoding frames not classified as voiced or unvoiced, but with a relatively low energy with respect to the long-term average energy, as those frames have low perceptual importance.

The coding methods for the above system are summarized in Table 2 and will be generally referred to as coding types. Other coding types can be used without loss of generality.

TABLE 2

Specific VMR-WB encoders and their brief description.

| Encoding Technique | Brief Description |
|---|---|
| Generic FR | General purpose FR codec based on AMR-WB at 12.65 kbit/s |
| Generic HR | General purpose HR codec |
| Voiced HR | Voiced frame encoding at HR |
| Unvoiced HR | Unvoiced frame encoding at HR |
| Unvoiced QR | Unvoiced frame encoding at QR |
| CNG ER | Comfort noise generator at ER |

The gain quantization codebook for the FR coding type is designed for all classes of signal, e.g. voiced, unvoiced, transient, onset, offset, etc., using training procedures well known to those of ordinary skill in the art. In the context of VBR coding, the Voiced and Generic HR coding types use both a pitch codebook and an innovation codebook to form the excitation signal. Thus similar to the FR coding type, the pitch and innovation gains (pitch codebook gain and innovation codebook gain) need to be quantized. At lower bit rates, however, it is advantageous to reduce the number of quantization bits that necessitate the design of new codebooks. Furthermore, for Voiced HR, a new quantization codebook is required for this class-specific coding type. Therefore, the non-restrictive illustrative embodiments of the present invention provides gain quantization in VBR CELP-based coding, capable of reducing the number of bits for gain quantization without the need to design new quantization codebooks for lower rate coding types. More specifically, a portion of the codebook designed for the Generic FR coding type are used. The gain quantization codebook is ordered based on the pitch gain values. The portion of the codebook used in the quantization is determined on the basis of an initial pitch gain value computed over a longer period, for example over two subframes or more, or in a pitch-synchronous manner over one pitch period or more. This will result in a reduction of the bit rate since the information regarding the portion of the codebook is not sent on a subframe basis. Furthermore, this will result in a quality improvement in case of stationary voiced frames since the gain variation within the frame will be reduced.

The unquantized pitch gain in a subframe is computed as $$g_p = \frac{\sum_{n=0}^{N-1} x(n)y(n)}{\sum_{n=0}^{N-1} y(n)y(n)} \tag{10}$$

where x(n) is the target signal, y(n) is the filtered pitch codebook vector, and N is the size of the subframe (number of samples in the subframe). The signal y(n) is usually computed as the convolution between the pitch codebook vector and the impulse response h(n) of the weighted synthesis filter. The computation of the target vector and filtered pitch codebook vector in CELP-based coding is well know to those of ordinary skill in the art. An example of this computation is described in the references [ITU-T Recommendation G.722.2 "Wideband coding of speech at around 16 kbit/s using Adaptive Multi-Rate Wideband (AMR-WB)", Geneva, 2002] and [3GPP TS 26.190, "AMR Wideband Speech Codec; Transcoding Functions," 3*GPP Technical Specification*]. In order to reduce the possibility of instability in case of channel errors, the computed pitch gain is limited to the range between 0 and 1.2.

First Illustrative Embodiment

In a first non-restrictive illustrative embodiment, while coding the first subframe of a four-subframe frame, an initial pitch gain $g_i$ is computed based on the first two subframes of the same frame using Equation (10), but for a length of 2N (two subframes). In this case, Equation (10) becomes:

$$g_i = \frac{\sum_{n=0}^{2N-1} x(n)y(n)}{\sum_{n=0}^{2N-1} y(n)y(n)} \tag{11}$$

Then, computation of the target signal x(n) and the filtered pitch codebook signal y(n) is also performed over a period of two subframes, for example the first and second subframes of the frame. Computing the target signal x(n) over a period longer than one subframe is performed by extending the computation of the weighted speech signal $s_w(n)$ and the zero input response $s_0$ over a longer period while using the same LP filter as in the initial subframe of the two first subframes for all the extended period; the target signal x(n) is computed as the weighted speech signal $s_w(n)$ after subtracting the zero-input response $s_0$ of the weighted synthesis filter $W(z)/\hat{A}(z)$. Similarly, computation of the weighted pitch codebook signal y(n) is performed by extending the computation of the pitch codebook vector v(n) and the impulse response h(n) of the weighted synthesis filter $W(z)/\hat{A}(z)$ of the first subframe over a period longer than the subframe length; the weighted pitch codebook signal is the convolution between the pitch codebook vector v(n) and the impulse response h(n), where the convolution in this case is computed over the longer period.

Having computed the initial pitch gain $g_i$ over two subframes, then during HR (half-rate) coding of the first two subframes, the joint quantization of the pitch $g_p$ and innovation $g_c$ gains is restricted to a portion of the codebook used for quantizing the gains at full rate (FR), whereby that portion is determined by the value of the initial pitch gain computed over two subframes. In the first non-restrictive illustrative embodiment, in FR (full-rate) coding type, the gains $g_p$ and $g_c$ are jointly quantized using 7 bits according to the quantization procedure described earlier; MA prediction is applied to the innovative excitation energy in the logarithmic domain to obtain a predicted innovation codebook gain and the correction factor y is quantized. The content of the quantization table used in the FR (full-rate) coding type are shown in Table 3 (as used in AMR-WB [ITU-T Recommendation G.722.2 "Wideband coding of speech at around 16 kbit/s using Adaptive Multi-Rate Wideband (AMR-WB)", Geneva, 2002] [3GPP TS 26.190, "AMR Wideband Speech Codec; Transcoding Functions," 3*GPP Technical Specification*]). In the first illustrative embodiment, the quantization of the gains $g_p$ and $g_c$ of the two subframes is performed by restricting the search of Table 3 (quantization table or codebook) to either the first or the second half of this quantization table according to the initial pitch gain value $g_i$ computed over two subframes. If the initial pitch gain value $g_i$ is less than 0.768606 then the quantization in the first two subframes is restricted to the first half of Table 3 (quantization table or codebook). Otherwise, the quantization is restricted to the second half of Table 3. The pitch value of 0.768606 corresponds to a quantized pitch gain value $g_p$ at the beginning of the second half of the quantization table (the top of the fifth column in Table 3). One bit is needed once every two subframes to indicate which portion of the quantization table or codebook is used for the quantization.

TABLE 3

Quantization codebook of pitch gain and innovation gain correction factor in an illustrative embodiment according to the present invention.

| $g_p$ | $\gamma$ |
|---|---|
| 0.012445 | 0.215546 |
| 0.028326 | 0.965442 |
| 0.053042 | 0.525819 |
| 0.065409 | 1.495322 |
| 0.078212 | 2.323725 |
| 0.100504 | 0.751276 |
| 0.112617 | 3.427530 |
| 0.113124 | 0.309583 |
| 0.121763 | 1.140685 |
| 0.143515 | 7.519609 |
| 0.162430 | 0.568752 |
| 0.164940 | 1.904113 |
| 0.165429 | 4.947562 |
| 0.194985 | 0.855463 |
| 0.213527 | 1.281019 |
| 0.223544 | 0.414672 |
| 0.243135 | 2.781766 |
| 0.257180 | 1.659565 |
| 0.269488 | 0.636749 |
| 0.286539 | 1.003938 |
| 0.328124 | 2.225436 |
| 0.328761 | 0.330278 |
| 0.336807 | 11.500983 |
| 0.339794 | 3.805726 |
| 0.344454 | 1.494626 |
| 0.346165 | 0.738748 |
| 0.363605 | 1.141454 |
| 0.398729 | 0.517614 |
| 0.415276 | 2.928666 |
| 0.416282 | 0.862935 |
| 0.423421 | 1.873310 |
| 0.444151 | 0.202244 |
| 0.445842 | 1.301113 |
| 0.455671 | 5.519512 |
| 0.484764 | 0.387607 |
| 0.488696 | 0.967884 |
| 0.488730 | 0.666771 |
| 0.508189 | 1.516224 |
| 0.508792 | 2.348662 |
| 0.531504 | 3.883870 |
| 0.548649 | 1.112861 |
| 0.551182 | 0.514986 |
| 0.564397 | 1.742030 |
| 0.566598 | 0.796454 |
| 0.589255 | 3.081743 |
| 0.598816 | 1.271936 |
| 0.617654 | 0.333501 |
| 0.619073 | 2.040522 |
| 0.625282 | 0.950244 |
| 0.630798 | 0.594883 |
| 0.638918 | 4.863197 |
| 0.650102 | 1.464846 |
| 0.668412 | 0.747138 |
| 0.669490 | 2.583027 |
| 0.683757 | 1.125479 |
| 0.691216 | 1.739274 |
| 0.718441 | 3.297789 |
| 0.722608 | 0.902743 |
| 0.728827 | 2.194941 |
| 0.729586 | 0.633849 |
| 0.730907 | 7.432957 |
| 0.731017 | 0.431076 |
| 0.731543 | 1.387847 |
| 0.759183 | 1.045210 |
| 0.768606 | 1.789648 |

TABLE 3-continued

Quantization codebook of pitch gain and innovation gain correction factor in an illustrative embodiment according to the present invention.

| $g_p$ | $\gamma$ |
|---|---|
| 0.771245 | 4.085637 |
| 0.772613 | 0.778145 |
| 0.786483 | 1.283204 |
| 0.792467 | 2.412891 |
| 0.802393 | 0.544588 |
| 0.807156 | 0.255978 |
| 0.814280 | 1.544409 |
| 0.817839 | 0.938798 |
| 0.826959 | 2.910633 |
| 0.830453 | 0.684066 |
| 0.833431 | 1.171532 |
| 0.841208 | 1.908628 |
| 0.846440 | 5.333522 |
| 0.868280 | 0.841519 |
| 0.868662 | 1.435230 |
| 0.871449 | 3.675784 |
| 0.881317 | 2.245058 |
| 0.882020 | 0.480249 |
| 0.882476 | 1.105804 |
| 0.902856 | 0.684850 |
| 0.904419 | 1.682113 |
| 0.909384 | 2.787801 |
| 0.916558 | 7.500981 |
| 0.918444 | 0.950341 |
| 0.919721 | 1.296319 |
| 0.940272 | 4.682978 |
| 0.940273 | 1.991736 |
| 0.950291 | 3.507281 |
| 0.957455 | 1.116284 |
| 0.957723 | 0.793034 |
| 0.958217 | 1.497824 |
| 0.962628 | 2.514156 |
| 0.968507 | 0.588605 |
| 0.974739 | 0.339933 |
| 0.991738 | 1.750201 |
| 0.997210 | 0.936131 |
| 1.002422 | 1.250008 |
| 1.006040 | 2.167232 |
| 1.008848 | 3.129940 |
| 1.014404 | 5.842819 |
| 1.027798 | 4.287319 |
| 1.039404 | 1.489295 |
| 1.039628 | 8.947958 |
| 1.043214 | 0.765733 |
| 1.045089 | 2.537806 |
| 1.058994 | 1.031496 |
| 1.060415 | 0.478612 |
| 1.072132 | 12.8 |
| 1.074778 | 1.910049 |
| 1.076570 | 15.9999 |
| 1.107853 | 3.843067 |
| 1.110673 | 1.228576 |
| 1.110969 | 2.758471 |
| 1.140058 | 1.603077 |
| 1.155384 | 0.668935 |
| 1.176229 | 6.717108 |
| 1.179008 | 2.011940 |
| 1.187735 | 0.963552 |
| 1.199569 | 4.891432 |
| 1.206311 | 3.316329 |
| 1.215323 | 2.507536 |
| 1.223150 | 1.387102 |
| 1.296012 | 9.684225 |

It should be noted that for the third and fourth subframes, a similar gain quantization procedure is performed. Namely, an initial gain $g_i$ is computed over the third and fourth subframes, then the portion of the gain quantization Table 3 (gain quantization codebook) to be used in the quantization procedure is determined on the basis of the value of this initial pitch gain $g_i$. Finally, the joint quantization of the two gains $g_p$ and $g_c$ is restricted to the determined codebook portion and one (1) bit is transmitted to indicate which portion is used; one (1) bit is required to indicate the table or codebook portion when each codebook portion corresponds to half the gain quantization codebook.

Figure 3:
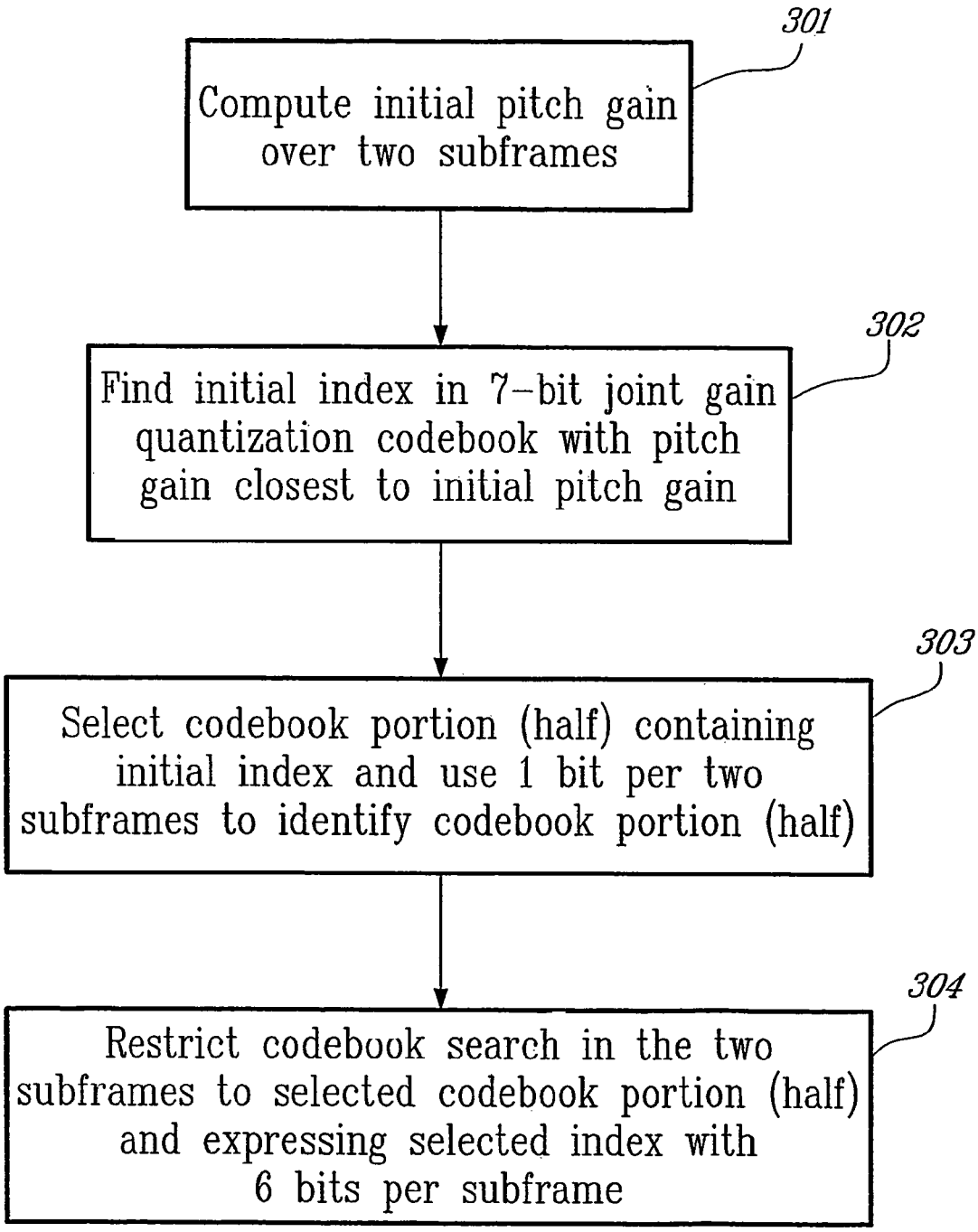
FIG. 3 is a schematic flow chart of a non-restrictive illustrative embodiment of the method according to the present invention.
Figure 4:
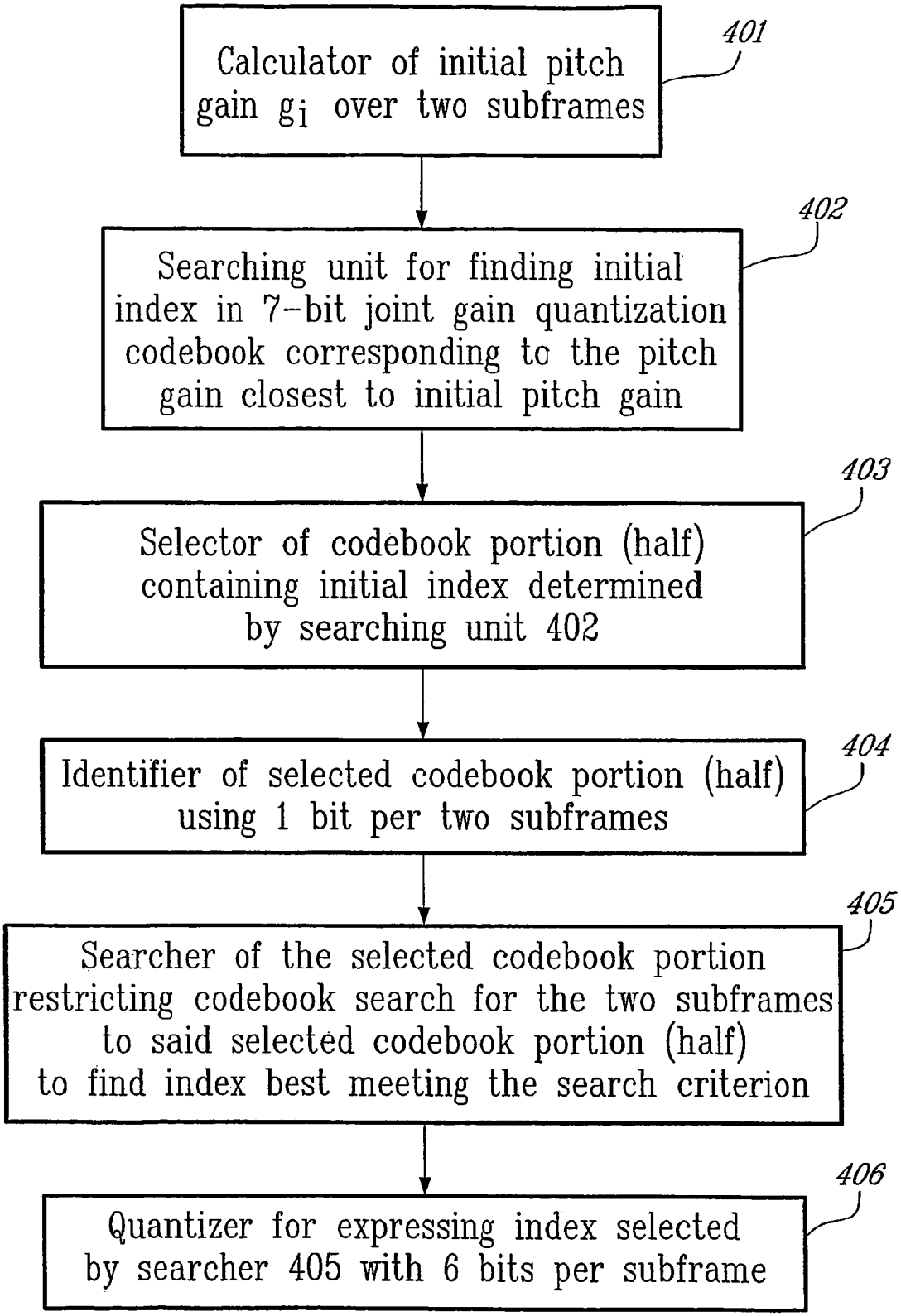
FIG. 4 is a schematic flow chart of a non-restrictive illustrative embodiment of the device according to the present invention.

FIGS. 3 and 4 are schematic flow chart and block diagram summarizing the above described first illustrative embodiment of the method and device according to the present invention.

Step 301 of FIG. 3 consists of computing an initial pitch gain $g_i$ over two subframes. Step 301 is performed by a calculator 401 as shown in FIG. 4.

Step 302 consists of finding, for example in a 7-bit joint gain quantization codebook, an initial index associated to the pitch gain closest to the initial pitch gain $g_i$. Step 302 is conducted by searching unit 402.

Step 303 consists of selecting the portion (for example half) of the quantization codebook containing the initial index determined during step 302 and identify the selected codebook portion (for example half) using at least one (1) bit per two subframes. Step 303 is performed by selector 403 and identifier 404.

Step 304 consists of restricting the table or codebook search in the two subframes to the selected codebook portion (for example half) and expressing the selected index with, for example, 6 bits per subframe. Step 304 is performed by the searcher 405 and the quantizer 406.

In the above-described first illustrative embodiment, 7 bits per subframe are used in FR (full-rate) coding to quantize the gains $g_p$ and $g_c$ resulting in 28 bits per frame. In HR (half-rate) voiced and generic coding, the same quantization codebook as FR (full-rate) coding is used. However, only 6 bits per subframe are used, and extra 2 bits are needed for the whole frame to indicate, in the case of a half portion, the codebook portion in the quantization every two subframes. This gives a total of 26 bits per subframe without memory increase, and with improved quality compared to designing a new 6 bit codebook as was found by experiments. In fact, experiments showed objective results (e.g. Segmental signal-to-noise ratio (Seg-SNR), average bit rate, . . . ) equivalent to or better than the results obtained using the original 7-bit quantizer. This better performance seems to be attributed to the reduction in gain variation within the frame. Table 4 shows the bit allocation of the different coding modes according to the first illustrative embodiment.

Another variation of the first illustrative embodiment can be easily derived for attaining more saving in the number of bits. For instance, the initial pitch gain can be computed over the whole frame, and the codebook portion (for example codebook half) used in the quantization of the two gains $g_p$ and $g_c$ can be determined for all the subframes based on the initial pitch gain value $g_i$. In this case only 1 bit per frame is needed to indicate the codebook portion (for example codebook half) resulting in a total of 25 bits.

According to another example, the gain quantization codebook, which is sorted based on the pitch gain, is divided into 4 portions and the initial pitch gain value $g_i$ is used to determine the portion of the codebook to be used for quantization process. For the 7-bit codebook example given in Table 3, the codebook is divided into 4 portions of 32 entries corresponding to the following pitch gain ranges: less than 0.445842, from 0.445842 to less than 0.768606, from 0.768606 to less than 0.962625, and more than or equal to 0.962625. Only 5 bits are needed to transmit the quantization index in each portion every subframe, then 2 bits are needed every 2 subframes to indicate the portion of the codebook being used. This gives a total of 24 bits. Further, the same codebook portion can be used for all four subframes which will need only 2 bits overhead per frame, resulting in a total of 22 bits.

Also, a decoder (not shown) according to the first illustrative embodiment comprises, for example, a 7-bit codebook used to store the quantized gain vectors. Every two subframes, the decoder receives one (1) bit (in the case of a codebook half) to identify the codebook portion that was used for encoding the gains $g_p$ and $g_c$, and 6-bits per subframe to extract the quantized gains from that codebook portion.

Second Illustrative Embodiment

The second illustrative embodiment is similar to the first one explained herein above in connection with FIGS. 3 and 4, with the exception that the initial pitch gain $g_i$ is computed differently. To simplify the computation in Equation (11), the weighted sound signal $s_w(n)$, or the low-pass filtered decimated weighted sound signal, can be used. The following relation results:

TABLE 4

Bit allocation for coding techniques used in the VMR-WB solution

| Parameter | Generic PR | Generic HR | Voiced HR | Unvoiced HR | Unvoiced QR | CNG ER |
|---|---|---|---|---|---|---|
| Class Info | — | 1 | 3 | 2 | 1 | — |
| VAD bit | — | — | — | — | — | — |
| LP Parameters | 46 | 36 | 36 | 46 | 32 | 14 |
| Pitch Delay | 30 | 13 | 9 | — | — | — |
| Pitch Filtering | 4 | — | 2 | — | — | — |
| Gains | 28 | 26 | 26 | 24 | 20 | 6 |
| Algebraic Codebook | 144 | 48 | 48 | 52 | — | — |
| FER protection bits | 14 | — | — | — | — | — |
| Unused bits | — | — | — | — | 1 | — |
| Total | 266 | 124 | 124 | 124 | 54 | 20 |

$$g'_p = \frac{\sum_{n=0}^{K-1} s_w(n)s_w(n-T_{OL})}{\sum_{n=0}^{K-1} s_w(n-T_{OL})s_w(n-T_{OL})} \quad (12)$$

where $T_{OL}$ is the open loop pitch delay and K is the time period over which the initial pitch gain $g_i$ is computed. The time period can be 2 or 4 subframes as described above, or can be multiple of the open-loop pitch period $T_{OL}$. For example, K can be set equal to $T_{OL}$, $2T_{OL}$, $3T_{OL}$, and so on according to the value of $T_{OL}$: a larger number of pitch cycles can be used for short pitch periods. Other signals can be used in Equation (12) without loss of generality, such as the residual signal produced in CELP-based coding processes.

Third Illustrative Embodiment

In a third non-restrictive illustrative embodiment of the present invention, the idea of restricting the portion of the gain quantization codebook searched according to an initial pitch gain value $g_i$ computed over a longer time period, as explained above, is used. However, the aim of using this approach is not to reduce the bit rate but to improve the quality. Thus there is no need to reduce the number of bits per subframe and send overhead information regarding the codebook portion used, since the index is always quantized for the whole codebook size (7 bits according to the example of Table 3). This will give no restriction on the portion of the codebook used for the search. Confining the search to a portion of the codebook according to an initial pitch gain value $g_i$ computed over a longer time period reduces the fluctuation in the quantized gain values and improves the overall quality, resulting in a smoother waveform evolution.

According to a non-limitative example, the quantization codebook in Table 3 is used in each subframe. The initial pitch gain $g_i$ can be computed as in Equation (12) or Equation (11), or any other suitable method. When Equation (12) is used, examples of values of K (multiple of the open-loop pitch period) are the following: for pitch values $T_{OL}<50$, K is set to $3T_{OL}$; for pitch values $51<T_{OL}<96$, K is set to $2T_{OL}$; otherwise K is set to $T_{OL}$.

After having computed the initial pitch gain $g_i$, the search of the vector quantization codebook is confined to the range $I_{init}-p$ to $I_{init}+p$, where $I_{init}$ is the index of the vector of the gain quantization codebook whose pitch gain value is closest to the initial pitch gain $g_i$. A typical value of p is 15 with the limitations $I_{init}-p \geqq 0$ and $I_{init}+p<128$. Once the gain quantization index is found, it is encoded using 7 bits as in ordinary gain quantization.

Of course, many other modifications and variations are possible to the disclosed invention. In view of the above detailed description of the present invention and associated drawings, such other modifications and variations will now become apparent to those skilled in the art. It should also be apparent that such other variations may be effected within the scope of the claims without departing from the spirit and scope of the present invention.

What is claimed is:

1. Apparatus providing gain quantization for use in coding a sampled sound signal represented in frames of samples, comprising:

a calculator to compute an initial pitch gain $g_i$ over two subframes;

a first searcher to locate, in a joint gain quantization codebook, an initial index associated to a pitch gain closest to the computed initial pitch gain $g_i$;

a selector to select a portion of the quantization codebook containing the located initial index;

an identifier to identify a selected codebook portion using at least one bit per two subframes;

a second searcher to restrict the codebook search in the two subframes to the selected codebook portion; and a quantizer to express a selected index with some number of bits per subframe;

where seven bits per subframe are used for Full-Rate (FR) coding to quantize pitch gain $g_p$ and innovation gain $g_c$ resulting in 28 bits per frame, where in Half-Rate (HR) voiced and generic coding the same quantization codebook as FR coding is used with only six bits per subframe and two additional bits are employed for the entire frame to indicate, in the case of a half portion, the codebook portion in the quantization every two subframes, giving a total of 26 bits per subframe, where bit allocations for expressing parameters for Generic FR, Generic HR, Voiced HR, Unvoiced HR, Unvoiced Quarter-Rate (QR) and Comfort Noise Generator-Eighth Rate (CNG-ER) are as follows:

| Parameter | Generic FR | Generic HR | Voiced HR | Unvoiced HR | Unvoiced QR | CNG ER |
|---|---|---|---|---|---|---|
| Class Info | — | 1 | 3 | 2 | 1 | — |
| VAD bit | — | — | — | — | — | — |
| LP Parameters | 46 | 36 | 36 | 46 | 32 | 14 |
| Pitch Delay | 30 | 13 | 9 | — | — | — |
| Pitch Filtering | 4 | — | 2 | — | — | — |
| Gains | 28 | 26 | 26 | 24 | 20 | 6 |
| Algebraic Codebook | 144 | 48 | 48 | 52 | — | — |
| FER protection bits | 14 | — | — | — | — | — |
| Unused bits | — | — | — | — | 1 | — |
| Total | 266 | 124 | 124 | 124 | 54 | 20. |

2. A method for encoding a sampled sound signal, the sampled sound signal comprising consecutive frames, each frame comprising a number of sub-frames, the method comprising:

determining a first gain parameter and a second gain parameter once per sub-frame and performing a joint quantization to jointly quantize the first and second gain parameters determined for a sub-frame by searching a quantization codebook comprising a number of codebook entries, each entry having an associated index represented with a predetermined number of bits, where the joint quantization comprises:

calculating an initial pitch gain over a time period that comprises a predetermined number f of sub-frames, where f is at least two;

selecting a portion of the quantization codebook in dependence on the initial pitch gain;

restricting the search of the quantization codebook to the selected portion for a first number, M, of consecutive sub-frames, where M is at least two; and searching the selected portion of the quantization codebook to identify a codebook entry best representing the first and second gain parameters for a sub-frame from within the selected portion of the quantization codebook and using the index associated with the identified entry to represent the first and second gain parameters for the sub-frame.

3. A method according to claim 2, comprising determining said initial pitch gain by computing the ratio of a first and a second correlation value.

4. A method according to claim 2, wherein the ratio of said first and second correlation values is:

$$\frac{\sum_{n=0}^{K-1} x(n)y(n)}{\sum_{n=0}^{K-1} y(n)y(n)}$$

where K represents the number of samples used in computing said first and second correlation values, x(n) is a target signal and y(n) is a filtered adaptive codebook signal.

5. A method according to claim 2, wherein the selected portion comprises half the quantization codebook entries in the quantization codebook.

6. A method according to claim 4, wherein K equals the number of samples in two sub-frames.

7. A method according to claim 4, comprising:

computing a linear prediction filter for a period equal to one sub-frame of the sampled sound signal, the linear prediction filter comprising a number of coefficients;

constructing a perceptual weighting filter based on the coefficients of the linear prediction filter; and constructing a weighted synthesis filter based on the coefficients of the linear prediction filter.

8. A method according to claim 7, comprising:

applying the perceptual weighting filter to the sampled sound signal over a period greater than one sub-frame to produce a weighted sound signal;

calculating a zero input response of the weighted synthesis filter; and generating the target signal by subtracting the zero input response of the weighted synthesis filter from the weighted sound signal.

9. A method according to claim 7, comprising:

calculating an adaptive codebook vector over a period greater than one sub-frame;

calculating an impulse response of the weighted synthesis filter; and forming the filtered adaptive codebook signal by convolving the impulse response of the weighted synthesis filter with the adaptive codebook vector.

10. A method according to claim 2, wherein the first gain parameter is a pitch gain and the second gain parameter is an innovation gain.

11. A method according to claim 2, wherein the first gain parameter is a pitch gain and the second gain parameter is an innovation gain correction factor.

12. A method according to claim 11, comprising:

applying a prediction scheme to an innovation codebook energy to produce a predicted innovation gain; and calculating the correction factor as a ratio of the innovation gain and the predicted innovation gain.

13. A method according to claim 2, comprising:

calculating the initial pitch gain on the basis of at least two sub-frames.

14. A method according to claim 2, comprising:

repeating the calculation of said initial pitch gain and said selection of a portion of the quantization codebook once every f sub-frames.

15. A method according to claim 2, wherein selecting a portion of the quantization codebook comprises:

searching the quantization codebook to find an index associated with a pitch gain value of the quantization codebook closest to the initial pitch gain; and selecting a portion of the quantization codebook containing said index.

16. A method according to claim 2 wherein f is a number of sub-frames in a frame.

17. A method according to claim 2, wherein restricting the search of the quantization codebook to the selected portion of the quantization codebook allows the index associated with the codebook entry best representing the first and second gain parameters for a sub-frame to be represented with a reduced number of bits.

18. A method according to claim 17, comprising restricting the search of the quantization codebook to one half of the quantization codebook for each of two consecutive sub-frames, thereby allowing the index associated with the codebook entry best representing the first and second gain parameters for a sub-frame to be represented with one less bit, an indicator bit being provided to indicate the half of the quantization codebook to which the search is restricted.

19. A method according to claim 2, comprising forming a bit-stream comprising encoding parameters representative of said sub-frames and providing an indicator indicative of a selected portion of the quantization codebook in the encoding parameters once every M sub-frames.

20. A method according to claim 2, wherein calculating the initial pitch gain comprises using the following relation:

$$g'_p = \frac{\sum_{n=0}^{K-1} s_w(n)s_w(n-T_{OL})}{\sum_{n=0}^{K-1} s_w(n-T_{OL})s_w(n-T_{OL})}$$

where $g'_p$ is the initial pitch gain, $T_{OL}$ is an open-loop pitch delay, and $s_w(n)$ is a signal derived from a perceptually weighted version of the sampled sound signal.

21. A method according to claim 20, wherein K represents an open-loop pitch value.

22. A method according to claim 20, wherein K represents a multiple of an open-loop pitch value.

23. A method according to claim 20, wherein K represents a multiple of the number of samples in a sub-frame.

24. A method according to claim 2, wherein restricting the search of the quantization codebook comprises confining the search to a range $I_{init}-p$ to $I_{init}+p$, where $I_{init}$ is an index of a gain vector of the quantization codebook corresponding to a pitch gain closest to the initial pitch gain and p is an integer.

25. A method according to claim 24, wherein p is equal to 15 with the limitations $I_{init}-p \geqq 0$ and $I_{init}+p<128$.

26. A storage medium tangibly encoded with an encoded sound signal encoded according to the method of claim 2.

27. A method for decoding a bit-stream representative of a sampled sound signal, the sampled sound signal comprising consecutive frames, each frame comprising a number of sub-frames, the bit-stream comprising encoding parameters representative of said sub-frames, the encoding parameters for a sub-frame comprising a first gain parameter and a second gain parameter, the first and second gain parameters having been jointly quantized and represented in the bit-stream by an index into a quantization codebook, the method comprising performing a gain dequantization to jointly dequantize the first and second gain parameters, where the gain dequantization comprises:

receiving in the encoding parameters an indication of a portion of the quantization codebook used in quantizing said first and second gain parameters for a first number, M, of sub-frames, where M is at least two; and for each of said M sub-frames extracting the first and second gain parameters from the indicated portion of the quantization codebook.

28. A method according to claim 27, wherein an indication of a portion of the quantization codebook is provided in the encoding parameters once every M sub-frames.

29. A method according to claim 27, wherein the first gain parameter is a pitch gain and the second gain parameter is an innovation gain.

30. A method according to claim 27, wherein the first gain parameter is a pitch gain and the second gain parameter is an innovation gain correction factor.

31. An encoder for encoding a sampled sound signal, the sampled sound signal comprising consecutive frames, each frame comprising a number of sub-frames, the encoder being arranged to determine a first gain parameter and a second gain parameter once per sub-frame and perform a joint quantization to jointly quantize the first and second gain parameters determined for a sub-frame by searching a quantization codebook comprising a number of codebook entries, each entry having an associated index represented with a predetermined number of bits, where the encoder is arranged to:

calculate an initial pitch gain over a time period that comprises a predetermined number f of sub-frames, where f is at least two;

select a portion of the quantization codebook in dependence on the initial pitch gain;

restrict the search of the quantization codebook to the selected portion for a first number, M, of consecutive sub-frames, where M is at least two;

search the selected portion of the quantization codebook to identify a codebook entry best representing the first and second gain parameters for a sub-frame from within the selected portion of the quantization codebook; and use the index associated with the identified entry to represent the first and second gain parameters for the sub-frame.

32. An encoder according to claim 31, wherein the encoder is arranged to determine the initial pitch gain by computing a ratio of a first and a second correlation value.

33. An encoder according to claim 32, wherein the encoder is arranged to compute the ratio of said first and second correlation values as:

$$\frac{\sum_{n=0}^{K-1} x(n)y(n)}{\sum_{n=0}^{K-1} y(n)y(n)}$$

where K represents the number of samples used in computing said first and second correlation values, x(n) is a target signal and y(n) is a filtered adaptive codebook signal.

34. An encoder according to claim 31, wherein the selected portion of the quantization codebook comprises half the quantization codebook entries in the quantization codebook.

35. An encoder according to claim 33, wherein K equals the number of samples in two sub-frames.

36. An encoder according to claim 33, wherein the encoder is arranged to:

compute a linear prediction filter for a period equal to one sub-frame of the sampled sound signal, the linear prediction filter comprising a number of coefficients;

construct a perceptual weighting filter based on the coefficients of the linear prediction filter; and construct a weighted synthesis filter based on the coefficients of the linear prediction filter.

37. An encoder according to claim 36, wherein the encoder is arranged to:

apply the perceptual weighting filter to the sampled sound signal over a period greater than one sub-frame to produce a weighted sound signal;

calculate a zero input response of the weighted synthesis filter; and generate the target signal by subtracting the zero input response of the weighted synthesis filter from the weighted sound signal.

38. An encoder according to claim 36, wherein the encoder is arranged to:

calculate an adaptive codebook vector over a period greater than one sub-frame;

calculate an impulse response of the weighted synthesis filter; and form the filtered adaptive codebook signal by convolving the impulse response of the weighted synthesis filter with the adaptive codebook vector.

39. An encoder according to claim 31, wherein the first gain parameter is a pitch gain and the second gain parameter is an innovation gain.

40. An encoder according to claim 31, wherein the first gain parameter is a pitch gain and the second gain parameter is an innovation gain correction factor.

41. An encoder according to claim 40, wherein the encoder is arranged to:

apply a prediction scheme to a innovation codebook energy to produce a predicted innovation gain; and calculate the correction factor as a ratio of the innovation gain and the predicted innovation gain.

42. An encoder according to claim 31, wherein the encoder is arranged to calculate the initial pitch gain on the basis of at least two sub-frames.

43. An encoder according to claim 31, wherein the encoder is arranged to repeat the calculation of said initial pitch gain and said selection of a portion of the quantization codebook once every f sub-frames.

44. An encoder according to claim 31, wherein the encoder is arranged to select a portion of the quantization codebook by:

searching the quantization codebook to find an index associated with a pitch gain value of the quantization codebook closest to the initial pitch gain; and selecting a portion of the quantization codebook containing said index.

45. An encoder according to claim 31, wherein f is the number of sub-frames in a frame.

46. An encoder according to claim 31, wherein the encoder is arranged to restrict the search of the quantization codebook to the selected portion of the codebook thereby allowing the index associated with the codebook entry best representing the first and second gain parameters for a sub-frame to be represented with a reduced number of bits.

47. An encoder according to claim 46, wherein the encoder is arranged to restrict the search of the quantization codebook to one half of the quantization codebook for each of two consecutive sub-frames, thereby enabling the index associated with the codebook entry best representing the first and second gain parameters for a sub-frame to be represented with one less bit, an indicator bit being provided to indicate the half of the quantization codebook to which the search is restricted.

48. An encoder according to claim 31, wherein the encoder is arranged to form a bit-stream comprising encoding parameters representative of said sub frames and provide an indicator indicative of a selected portion of the quantization codebook in the encoding parameters once every M sub-frames.

49. An encoder according to claim 31, wherein the encoder is arranged to calculate the initial pitch gain comprises using the following relation:

$$g'_p = \frac{\sum_{n=0}^{K-1} s_w(n)s_w(n-T_{OL})}{\sum_{n=0}^{K-1} s_w(n-T_{OL})s_w(n-T_{OL})}$$

where $g'_p$ is the initial pitch gain, $T_{OL}$ is an open-loop pitch delay, and $s_w(n)$ is a signal derived from a perceptually weighted version of the sampled sound signal.

50. An encoder according to claim 49, wherein K represents an open-loop pitch value.

51. An encoder according to claim 49, wherein K represents a multiple of an open-loop pitch value.

52. An encoder according to claim 49, wherein K represents a multiple of the number of samples in a sub-frame.

53. An encoder according to claim 31, wherein the encoder is arranged to restrict the search of the quantization codebook by confining the search to a range $I_{init}-p$ to $I_{init}+p$, where $I_{init}$ is an index of a gain vector of the gain quantization codebook corresponding to a pitch gain closest to the initial pitch gain and p is an integer.

54. An encoder according to claim 53, wherein p is equal to 15 with the limitations $I_{init}-p \geqq 0$ and $I_{init}+p<128$.

55. A cellular telephone comprising an encoder according to claim 31.

56. A speech communication system comprising an encoder according to claim 31.

57. A decoder for decoding a bit-stream representative of a sampled sound signal, the sampled sound signal comprising consecutive frames, each frame comprising a number of sub-frames, the bit-stream comprising encoding parameters representative of said sub-frames, the encoding parameters for a sub-frame comprising a first gain parameter and a second gain parameter, the first and second gain parameters having been jointly quantized and represented in the bit-stream by an index into a quantization codebook, the decoder being arranged to perform a gain dequantization to jointly dequantize the first and second gain parameters, where the decoder is arranged to:

retrieve an indication from the encoding parameters, said indication indicative of a portion of the quantization codebook used in quantizing said first and second gain parameters for a first number, M, of sub-frames, where M is at least two;

extract the first and second gain parameters for each of said M sub-frames from the indicated portion of the quantization codebook.

58. A decoder according to claim 57, wherein the decoder is arranged to retrieve an indication of a portion of the quantization codebook from the encoding parameters once every M sub-frames.

59. A decoder according to claim 57, wherein the first gain parameter is a pitch gain and the second gain parameter is an innovation gain.

60. A decoder according to claim 57, wherein the first gain parameter is a pitch gain and the second gain parameter is an innovation gain correction factor.

61. A cellular telephone comprising a decoder according to claim 57.

62. A speech communication system comprising a decoder according to claim 57.

63. A storage medium tangibly encoded with a bit-stream representative of a sampled sound signal, the sampled sound signal comprising consecutive frames, each frame comprising a number of sub-frames, the bit-stream comprising encoding parameters representative of said sub-frames, the encoding parameters for a sub-frame comprising a first gain parameter and a second gain parameter, which are jointly quantized and represented in the bit-stream by an index into a quantization codebook, where the bit-stream comprises an indicator indicative of a portion of the quantization codebook used to quantize the first and second gain parameters for a first number, M, of sub-frames, where M is at least two.

64. A storage medium according to claim 63, wherein the portion of the quantization codebook used to quantize the first and second gain parameters for said M sub-frames having been determined based upon an initial pitch gain calculated on the basis of a predetermined number f of sub-frames, where f is at least two.

* * * * *